United States Patent [19]

Görike

[11] 4,278,852

[45] Jul. 14, 1981

[54] EARPHONE CONSTRUCTION

[75] Inventor: Rudolf Görike, Vienna, Austria

[73] Assignee: AKG Akustische u. Kino-Gertäte Gesellschaft m.b.H., Austria

[21] Appl. No.: 937,439

[22] Filed: Aug. 28, 1978

[30] Foreign Application Priority Data

| | | | |
|---|---|---|---|
| Aug. 31, 1977 | [AT] | Austria | 6285/77 |
| Nov. 9, 1977 | [AT] | Austria | 8010/77 |
| Mar. 2, 1978 | [AT] | Austria | 1493/78 |

[51] Int. Cl.[3] ..... H04R 1/10; H04R 7/04

[52] U.S. Cl. ..... 179/182 R; 179/115.5 PV; 179/181 R

[58] Field of Search ..... 179/182 R, 156 R, 110 A, 179/111 R, 111 E, 115.5 PV, 180, 181 R

[56] References Cited

U.S. PATENT DOCUMENTS

| | | | |
|---|---|---|---|
| 1,368,307 | 2/1921 | Waldron | 179/182 R |
| 2,407,731 | 9/1946 | Woodruff | 179/182 R |
| 2,856,469 | 10/1958 | Morse | 179/182 R |
| 3,272,926 | 9/1966 | Falkenberg | 179/156 R |
| 3,488,456 | 1/1970 | Lahti | 179/156 R |
| 3,632,903 | 1/1972 | Lange | 179/111 R |
| 3,829,623 | 8/1974 | Willis et al. | 179/115.5 PV |
| 3,898,598 | 8/1975 | Asahi | 179/115.5 PV X |
| 4,005,278 | 1/1977 | Gorike | 179/181 R |
| 4,041,256 | 8/1977 | Ohta et al. | 179/182 R |
| 4,071,717 | 1/1978 | Fidi et al. | 179/182 R |
| 4,081,627 | 3/1978 | Crist | 179/115.5 PV |

FOREIGN PATENT DOCUMENTS

| | | | |
|---|---|---|---|
| 2345850 | 3/1975 | Fed. Rep. of Germany | 179/156 R |
| 566697 | 9/1975 | Switzerland | 179/111 R |
| 1091490 | 11/1967 | United Kingdom | 179/156 R |

OTHER PUBLICATIONS

"The Electrostatic Earphone", by Walter T. Selsted, *Journal of the Audio Engineering Society*, vol. 9, No. 2, Apr. 1961.

*Primary Examiner*—Thomas W. Brown
*Attorney, Agent, or Firm*—McGlew and Tuttle

[57] ABSTRACT

An earphone construction for a wearer's ear, comprises an ear pad which is adapted to surround the ear and is advantageously constructed of a wedge-shaped tapered configuration and of annular form so that the inner edge bounding the inside of the ear along the cheekbone is of a narrower width than the outer portion and the outer portion tapers downwardly from the wide portion bounding the upper part of the ear to a lower portion adjacent the lower part of the ear which does not project outwardly from the head as much as the upper portion. At least one electroacoustic transducer is provided which includes a diaphragm which is surface-driven and which is mounted in, and supported at its periphery, on a transducer frame connected to the ear pad. The diaphragm is thus supported by the frame which also supports ferromagnetic plates on each side of the diaphragm having magnetic rods which are spaced from the respective sides of the diaphragm. A wall of the frame itself may include an electroacoustic transducer, particularly in those instances where a flat ear pad is employed. The diaphragm may advantageously comprise a thin, plastic foil sheet having a printed circuit or circuits defined thereon. Separate electrodes may advantageously be provided surrounding respective areas of the diaphragm and connected separately to transformers.

11 Claims, 17 Drawing Figures

EARPHONE CONSTRUCTION

FIELD AND BACKGROUND OF THE INVENTION

This invention relates in general to sound headsets and, in particular, to a new and useful earphone which is equipped with ear pads and having at least one electroacoustic transducer in each earphone, comprising, a surface-driven diaphragm which operates, for example, on the orthodynamic or electrostatic principle of conversion.

DESCRIPTION OF THE PRIOR ART

Headsets with a surface-driven diaphragm have good sound transmission properties and, for this reason, they are generally employed in binaural transmissions of acoustic events, with at least one acoustic transducer associated with each ear. However, headsets of this design also produce an undesirable effect which is referred to as the "in-the-head localization" of the transmitted acoustic event. In other words, the user of the headset does not have the impression that the sound is coming from the outside, but rather perceives the sound as being produced inside his head. It is true that in a binaural transmission, this effect is attenuated, but the impression which is produced, for example, by a reproduction through a loud-speaker assembly, cannot be obtained at the present time with headsets.

SUMMARY OF THE INVENTION

The present invention is directed to a headset of the circumaural design, in which the undesirable localization of the transmitted acoustic event in the head is avoided and, consequently, the impression produced in that the acoustic event reaches the ear from the outside. In accordance with the invention, this is obtained by providing that the surface-driven diaphragm is joined by its perimeter directly to a frame which is connected to the pad surrounding the ear.

The invention construction is based on the experience that as long as acoustic events are picked up by microphones which do not produce any ear resonances important to the directional and distance hearing and occurring during natural hearing, and as long as those pickups are intended for reproduction by means of loudspeakers where the ear resonances occur during the auditory perception, it is necessary, if such pickups are to be reproduced by means of headsets, to incorporate these ear resonances into the transmission path between the microphones and the eardrum. This may be accomplished in the simplest and most reliable way by utilizing the acoustic properties of the user's external ears, since then the individual properties of the auricle and the outer auditory canal are fully taken into account.

It has been found, particularly in the range between 1.5 and 20 kHz, that the influences of the external ear and outer auditory canal result in extraordinarily distinct and characteristic peaks and troughs in the transmission response curve and, at the same time, that clear and specific differences appear as a function of the angle of incidence of the sound waves and the distance of the sound source. On the contrary, in the frequency range of 16 to 800 Hz, no influence of the external ear on the transmission response has been found.

Another prerequisite for an auditory perspective obtained by means of headsets is to avoid transmission imperfections. In headsets of the prior art, such imperfections are caused by sound-reflecting surfaces in the vicinity of the external ear, which disturb the individual acoustic properties thereof. The diaphragm of an acoustic transducer, for example, a moving coil system with a surface of about 5 $cm^2$ and a mass of 0.2 g, reflects sound waves just in the critical frequency range of 3 kHz and above, whereby, the acoustic event is located close to the ear. This is perceived with particular clarity if white noise is produced by means of an octave or one-third octave filter.

The inventive headset is provided with a diaphragm of the transducer with such a specific mass and dimensions that it can be neglected as a reflector of higher-frequency sound waves and, in addition, it is constructed in such a manner that any surfaces reflecting in the higher frequency range and limiting the coupling space between the ear and the diaphragm are avoided.

The orthodynamic system is preferably for the acoustic transducer, since this system makes it possible to use a diaphragm which is of an extremely small weight, in connection with a drive which is effective over the entire surface of the diaphragm. The inventive headset, however, is also suitable for an electrostatic system, particularly, one with an electric diaphragm, which may be associated with an electrodynamic low-frequency system, in order to improve the bass response.

Up to the present time, orthodynamic headsets have been known only in supraaural design, wherein the ear pad is supported on the user's external ear. This eliminates the resonances of the external ear, and only the resonance of the outer auditory canal becomes effective, whereby, the transmission response is increased by about 10 db in the region of about 2.5 kHz. In the important range of 3 to 16 kHz, however, transmission disturbances occur due to the absence of ear resonances. Since the sound opening in the center of the ear pad is substantially smaller than the diaphragm surface, interferences of the sound waves occur in the low chamber in front of the diaphragm, and losses occur in the high-frequency range. The inventive headset is not affected with such drawbacks. In the inventive headset, the diaphragm surface exceeds the size of the external ear, so that while utilizing the principle of circumaural coupling, reflecting surfaces no longer appear. By selecting very thin foils, for example, of a polyester in the thickness of from 3 to 10 microns, the specific mass of the diaphragm is kept so low that its radiation resistance in the higher frequency range is higher than its mechanical impedance.

An analysis of the acoustic conditions results in the following picture:

The diaphragm surface is about 40 $cm^2$. Its mass is about 0.04 g. The radiation resistance of a circular diaphragm in mechanical ohms is given by the formula:

$$R_S = \delta \cdot C \cdot \pi \cdot r^2 \cdot h$$

wherein $\delta$ = the density of air in $g/cm^3 = 1 \cdot 2 \cdot 10^{-3}$ $c$ = sound velocity in cm/sec $= 3.44 \cdot 10^4$ $r$ = radius of a circle of equal area of 40 $cm^2$ = 3.7 cm $h = 1 - (2\tau 1/y)$ $y = 4\pi R/\lambda$ $\lambda$ = wavelength in cm $\tau 1$ = Bessel function of the first order The values of h may be learned from the curve shown in FIG. 7. As computed for three frequencies, namely, 200, 1000 and 5000 Hz, the resulting value of h is 0.02, 0.12 and 1.1, and the value of $R_S$ is 27, 160, and 1460Ω, respectively. For the mentioned three frequencies, the mechanical impedance $\omega \cdot m$ of the diaphragm mass of 0.04 g is 48, 20· and 1200Ω. The logarithmic decrement $d = R \cdot \pi / \omega_o \cdot M$ (wherein R is the frictional resistance, M is the mass of the oscillatory system) is shown in FIG. 8 as a parameter. For values of 1.7–3, it furnishes enough damping for an oscillatory system. In comparison therewith, the values of $R_S$ result in a satisfactory damping of the diaphragm. For diaphragm masses exceeding 0.04 g, an additional acoustic frictional resistance is advantageously provided in front of the diaphragm, which resistance is kept as low as possible.

If, in addition, the restoring force of the diaphragm is adjusted to have the resonance of the diaphragm in the low-frequency range, in practice, sound waves pass through without reflection, particularly if the necessary damping decrement is furnished by the radiation resistance. This means that the coupling space behaves as if no diaphragm would be present. With the diaphragm oscillating, and thus transmitting sound, the physical conditions approach a situation in which all soundwaves would reach the ear from the outside, without interference from the diaphragm. In such a case, the acoustic properties of the external ear and the outer auditory canal can take effect perfectly.

The technological progress achieved by the invention can be ascertained by subjective experience if, aside from listening to music, a simple test is made in addition. To this end, noise as a continuous succession of statistically distributed pulses, is used as the test signal. This may be done, for example, by means of a ratio set on UHF tuned to a location between transmitters, or simply by utilizing the ambient noise from a long distance, such as the city noise level or the rush of the wind in tree tops. A comparison of perception with and without the headset on, with the headset not being electrically connected, no difference will be found in the timbre of sound in the higher frequency range if no reflections are produced in the coupling space except for those of the external ear and the auditory canal. These conditions are substantially met in the headset of the invention.

With the natural resonance of the diaphragm being in the low frequency range, for example, at 400 Hz, the damping or loss resistance alone which is advantageously due to the radiation resistance of the diaphragm, is effective in the resonance. Below the resonance frequency, the restoring force is prevalent, and above the resonance frequency, the mass of the diaphragm is prevalent. However, with a satisfactorily firm coupling of the diaphragm with the surrounding air through the radiation resistance of the diaphragm exceeding the mechanical impedance thereof, no reflections can occur on the diaphragm. It is therefore particularly advantageous for the inventive headset if all of the boundary surfaces of the coupling space are designed as active transducer diaphragms radiating the sound inphase. It may be advantageous to provide other phase relations only in quadraphonic or other transmission methods operating with more than two channels.

In the simplest embodiment of the invention, in which a single large surface diaphragm and a circumaural ear pad are provided, distinctly improved acoustic properties may already be perceived, particularly with distance hearing. The orthodynamic drive is preferred, but an electrostatic drive system may also be used, for example, an electret diaphragm having a small thickness of about 3 microns and thus a very small mass, which results in extremely favorable conditions. An unfavorable condition arises in this case, however, since due to the static attraction between the diaphragm and the counterelectrode, the diaphragm is tuned relatively high, so that the frictional resistance to produce the necessary damping also becomes high, whereby, the sound passage is unfavorably affected. As already mentioned, a further transducer system is needed, in addition, for the low frequencies, but this system requires only a small sound opening to the coupling space so that, in this regard, no disturbances by undesirable reflections in the coupling space are to be expected.

In a first embodiment of the invention, the surface-driven diaphragm advantageously extends in a plane intersecting the annular ear pad obliquely, or the ear pad itself advantageously has a generally tapering, wedge-like shape. The sole purpose of such measures is to adapt the position of the diaphragm to the user's external ear, while at the same time, reducing the area of the ear pad surfaces which bound a part of the coupling space and could reflect sound, to a minimum.

Another reduction of the ear pad surfaces confining the coupling space is obtained by providing two surface-driven diaphragms joining each other at an approximately right angle and connected to a flat ear pad by further limiting walls in wedge-like configuration.

For special purposes, an embodiment is provided comprising more than two surface-driven diaphragms and is particularly suited, for example, for a quadraphonic transmission, since the diaphragms may be provided in an arrangement corresponding to that of the microphones on the pickup side.

In still another embodiment of the invention, also suitable for quadraphonic or other methods using more than two channels, at least two drive systems, independent of each other, are associated in each earpiece with the surface-driven diaphragm which is joined by its perimetric portion directly to the pad surrounding the ear and has an extremely small mass. In such an embodiment, which is used with an electrodynamic drive system, there are, for example, two diaphragm areas which are each provided with any number of conductor tracks, for example, in the form of a printed circuit, so that each diaphragm zone is driven substantially independently of the other. In this case, it is not absolutely necessary to change the magnetic system since the conductor tracks can be provided so as to fully coincide with the array of the magnetic rods.

If, on the other hand, an electrostatic drive is provided, the diaphragm is advantageously enclosed between a plurality of electrode pairs, in a number corresponding to that of the channels, with each pair of electrodes being formed by two electrodes in symmetrically opposite position relative to the diaphragm.

In arrangements similar to those described above, further diaphragms, extending in other planes may be provided, in addition to a large surface diaphragm which, in accordance with the invention, is driven by two mutually independent drive systems. Any of the diaphragms in angular position relative to each other may also be electrically united, or associated with transmission channels of their own. In this way, it is possible, depending on the position of the individual diaphragm surfaces relative to each other or by means of a partial drive of the surfaces and power supply to the surface combination to stimulate the ear resonances in a manner corresponding to natural hearing.

The extremely light diaphragm provided in all of the embodiments of the invention does not represent an appreciable resistance to the sound waves and, in practice, does not cause any reflection. Since the back side of the diaphragm, i.e., the side which is remote from the ear in use can radiate into the free surrounding space without hindrance, it is sometimes annoying for a person present in the vicinity to listen in. This is unpleasant particularly because the sound impression in the ambience is characterized by a high proportion of frequencies between 1 kHz and 12 kHz, so that an acoustic pattern is perceived in which the medium and low frequencies are absent. To reduce or eliminate the radiation of disturbing sound to the ambience in the mentioned frequency range, a porous, so-called sound deadening material is placed close to the backside of the diaphragm, extending over the entire surface area thereof and, particularly, absorbing acoustic oscillations in the medium and higher hearing ranges, so that the sound energy of the medium and high frequencies, upon entering the porous material and due to internal friction is converted into heat and dissipated, while in the frequency range below, the sound energy is damped in smaller amounts with the decreasing frequency and passes through the porous material. Due to this provision, the conditions the invention is based upon are not distrubed, since neither the lower frequency sound waves passing through the porous material nor the medium and higher frequency sound waves absorbed therein can pass back to the diaphragm and, thereby, to the coupling space at the ear. The degree of absorption, i.e., the relation between the reflected and the incident sound waves, is given by the formula:

$$S = 1 - \left(\frac{P_r}{P_i}\right)^2,$$

if the intensities of the two waves are compared with each other, wherein $P_r$ is the acoustic pressure of the reflected wave and $P_i$ is the acoustic pressure of the incident wave. To satisfy the inventive requirement of a large freedom from reflection, S should approach the value of 1.

In practice, the sound deadening element will be made of a porous, sound-absorbing material having narrow pores or channels where the sound energy is converted by internal friction into heat (dissipated).

Insofar as sound waves of the frequency range above 1 kHz would still pass through the sound-absorbing element, they must be damped to the extent that they are substantially no longer audible. From the standpoint of freedom from reflection, as required in accordance with the invention, in this connection, it is of no importance how many sound waves are converted to heat and what proportion is allowed to pass through the material. In the higher frequency range, however, it is desirable to convert into heat as much of the sound energy as possible. In general, the acoustic power allowed to pass through the sound deadening element would be in an amount of about 6 to 20 db less than the incident power, which value is satisfactory to attain the effect intended by the invention. Accordingly, in the frequency range of 1 kHz and more, the porous material is capable of converting sound into heat. On the contrary, in the lower frequency range, the passage of the sound waves is substantially unhindered which, however, does not cause any disturbing acoustic event in the surroundings of the user of the headset. In some instances, it may be advantageous to provide a small acoustic frictional resistance in this frequency range having a value ensuring a critical damping of the diaphragm resonance of about 400 Hz, unless the radiation resistance of the diaphragm itself would provide a satisfactory damping. Therefore, basically, the values obtained relating to the absorbing capacity as a function of the frequency depend on the properties and the thickness of the damping material.

In accordance with the teaching of the invention, reflections in the earpieces are to be substantially eliminated. Thus, the porous material is to be arranged or built-in in a manner such as to avoid reflecting surfaces. This must be kept in mind particularly if the damping material has no stiffness of its own and, consequently, to maintain its shape, must be accommodated in a case inherently stable in shape but completely permeable to sound. Wire-lattice or similar structures are advantageously used for this purpose, which are suitable also in view of the required freedom from reflection. A case may be omitted, however, if a porous material is used which is itself stable in shape, for example, a sintered material or felt reinforced with a stiffening impregnation.

The attempt to connect the sound passage by a rigid wall is frustrated by the fact that in order to hold the restoring force for the diaphragm within limits, such a case on the backside of the acoustic frictional resistance ought to have a volume making a headset of similar design incapable on being sold. Cases with a depth of 20 to 30 cm would be needed as the lower limit.

Accordingly, it is an object of the invention to provide an earphone for a person's ear which comprises an ear pad adapted to surround the ear and a transducer having a surface driven diaphragm which is provided with a periphery which is joined to the ear pad.

A further object of the invention is to provide an earpiece which includes an ear pad which may be either flat or wedge-shaped in order to conform to the usual configuration of a person's ear, and supports a surface-driven diaphragm of a transducer from the ear pad closely adjacent the ear and wherein the construction includes a housing carrying ferromagnetic plates having pole pieces which are disposed on each side of the transducer in spaced relation thereto and also the transducer may advantageously include a printed circuit or circuits and include portions which have separate power actuation.

Another object of the invention is to provide an earphone or a headset of circumaural design in which the undesirable localization of the transmitted acoustic event in the person's head is avoided and the impression is produced as the acoustic event reaches the ear from the outside.

A further object of the invention is to provide an earphone or headset which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
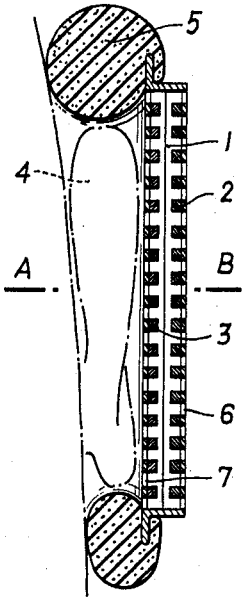
FIG. 1 is a diagrammatical sectional view of a first simple embodiment of the invention.

Referring to the drawings in particular, the invention embodied therein, comprises an earpiece for a headset of a sound-operating device which includes an ear pad 5 which is adapted to be positioned around a person's ear 4 and which includes a surface-driven diaphragm 1 joined by its periphery directly to a frame which is connected to pad 5 surrounding the ear.

FIG. 1 shows an orthodynamic transducer system in the form of a headphone or earpiece, in a vertical sectional view. In accordance with the invention, a relatively large, annular ear pad 5 is provided surrounding the user's ear 4, in a substantially contact-free fashion. The diaphragm 1, is provided with electric conductors, such as aluminum, in the form of a printed circuit extending over the entire surface are of the diaphragm. The printed circuit extends on all sides beyond the area occupied by the external ear 4 and its marginal zones reach the vicinity of pad 5, so that the coupling space surrounding ear 4 is substantially formed solely by the inside wall surfaces of pad 5 and by diaphragm 1.

The magnetic system is of a design usual in orthodynamic transducers and comprises, substantially, alternately polarized magnetic rods 2 and 3 and ferromagnetic baseplates 6 and 7, with the latter being made of a perforated low-retentivity sheet material, so that the sound waves can pass through the magnetic system without hindrance. Diaphragm 1 is positioned in the plane of symmetry of the magnetic system, and the gap to the pole rods 2 and 3 is of a dimension which still permits free oscillation of the diaphragm which is made of an extremely thin plastic. This facilitates the heat dissipation from the aluminum conductor, so that current loads of up to 30 A/mm$^2$ are harmless.

Figure 2:
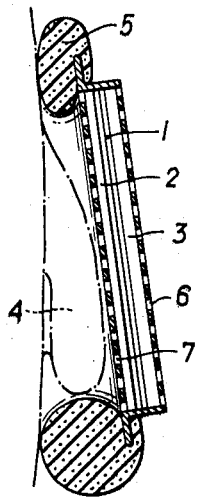
FIG. 2 is a sectional view taken on the line A—B of FIG. 1.
Figure 3:
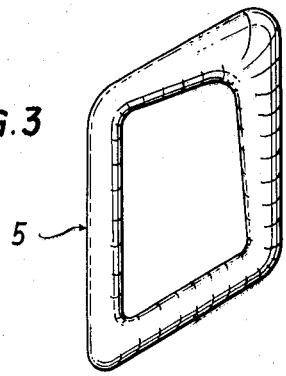
FIG. 3 shows a generally tapered or wedge-shaped ear pad such as used, for example, in FIG. 2.

It may be learned from FIG. 2 that in order to avoid a larger annular pad surface on the inside, which could cause reflections and, consequently cross-resonances in the high frequency range, ear pad 5 is designed in a substantially wedge-like shape, as is particularly and more clearly shown in FIG. 3. The wedge-shape adapts to the geometry of the human head since, at the side of the face, the ear blends continuously into the cheek while, at the backside, the ear is more or less spaced from the head. Therefore, diaphragm 1 of the inventive headphone does not extend perpendicularly to the ear axis, but forms an obtuse angle therewith. In addition to the showing of FIG. 3, it should be noted that instead of being rectangular, the ear pad might also be rounded, for example, of an oval configuration or other suitable shape.

Figure 4:
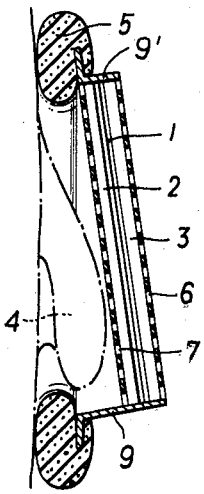
FIG. 4 is a diagrammatical section view, similar to FIG. 2, of an inventive headphone in which a flat ear pad is used.

If a flat ear pad is used, a limiting wall 9 of a greater width than opposite side wall 9' is advantageously provided in addition, as shown in the embodiment of FIG. 4.

Figure 5:
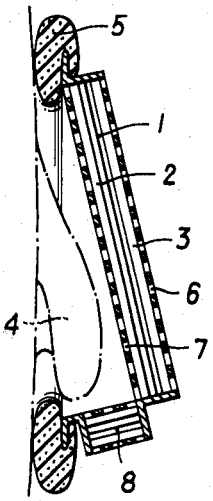
FIG. 5 is a headphone comprising two surface-driven diaphragms which are arranged sequentially and extend approximately at a right angle to each other and are joined to a flat ear pad by means of further, wedge-shaped limiting surfaces or walls.

To further reduce a disturbing influence of the ear pad boundary of the coupling space, the inside surface areas of pad 5 tending to reflections must be minimized. A design complying therewith is seen in FIG. 5, wherein an ear pad 5, in the form of a very low, flat ring is provided. This is made possible by providing an additional diaphragm part 8 which acts with diaphragm 1 to now form that boundary portion of the coupling space which, in the preceding embodiment, was formed by the thicker portion of the wedge-like ear pad. Diaphragm 8 is also a part of an orthodynamic transducer system, the design of which is identical with that of diaphragm 1.

Figure 6:
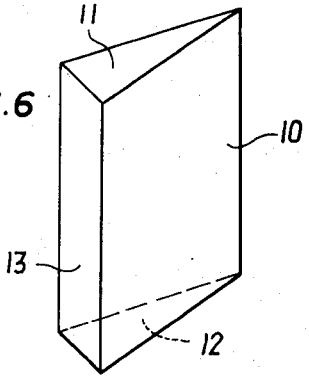
FIG. 6 diagrammatically shows that even more boundary surfaces of the coupling space may be provided with, or formed by, surface-driven diaphragms.
Figure 7:
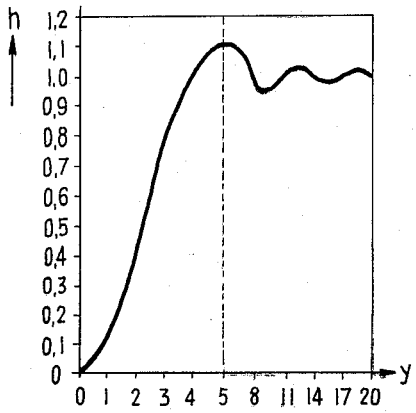
FIGS. 7 and 8 are function curves intended to better explain the invention.
Figure 8:
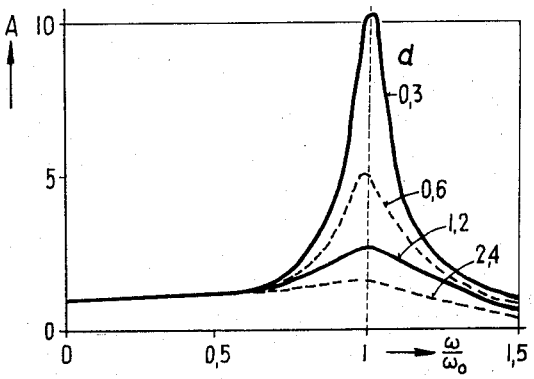

In order to further eliminate reflections and to thus increase the effect sought by the invention, the walls of a wedge-shape coupling space may be formed by diaphragms 10, 11, 12 and 13, of an orthodynamic drive system, as diagrammatically illustrated in FIG. 6. All of the diaphragms may oscillate in phase, as required for example, in a binaural transmission of acoustic events. In a multi-channel, for example, a quadraphonic transmission, each transmission channel may be associated with a transducer system of its own. In other words, the invention makes it possible to bound the coupling space with a number of orthodynamically or electrostatically driven diaphragms corresponding to the number of transmission channels.

Since it is well known that the sound waves coming from the three spatial directions cause different transmission characteristics at the ears, which are evaluated nonaurally and interaurally for producing the directional and distance impression, the inventive arrangement and the extremely light diaphragms make it possible, by eliminating all reflections in the coupling space, to perceive the signals delivered by the headset largely as natural hearing signals.

Figure 9:
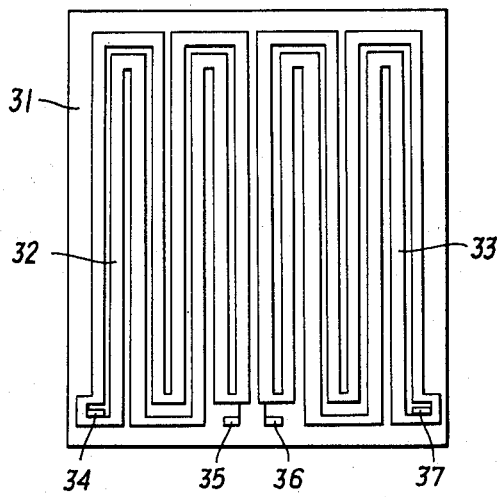
FIG. 9 is a top view of a diaphragm provided with two printed circuits which are independent of each other.

An orthodynamic headphone diaphragm 31 is provided in the embodiment of FIG. 9. The diaphragm preferably carries two identical printed circuits 32 and 33 which may comprise meandering conductor tracks, and terminals 34, 35, 36 and 37. Diaphragm 31 should be kept as thin as possible and, in accordance with today's foil-producing possibilities, may have a thickness of from 2 to 3 microns. Aluminum is preferably used for producing the conductor tracks. If they are made of an aluminum foil glued to diaphragm 31, they must have a thickness of 3 to 6 microns. If they are deposited by evaporation, the resulting thickness is 0.5 to 1 micron.

In order to eliminate material stresses, diaphragm 31 may be provided with very shallow embossments, for example, of a depth of 10 microns. Preferably, as already mentioned, the mechanical impedance of the diaphragm in the audible frequency range is to be negligibly small relative to the acoustic radiation resistance thereof. The limits are given by the technology and the thermal behavior, while also taking into account the heat dissipation from the conductor tracks through the adjacent metal parts of the magnetic system. The lines of printed circuits 32 and 33 in FIG. 9 only indicate the limits of a plurality of parallel conductors. In practice, for example, a conductor track of 2 mm in width may accommodate six individual conductors, which results in electric resistances of about between 200 and 600 ohms.

Figure 10:
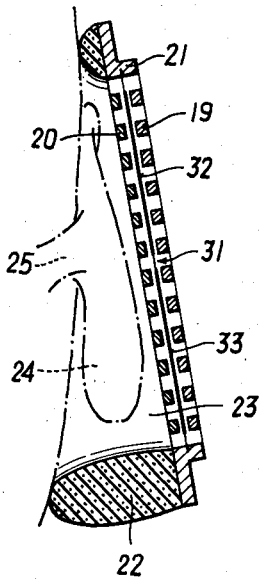
FIG. 10 is a diagrammatical sectional view of an orthodynamic transducer in an operational position at the ear.

FIG. 10 shows the coupling of the above-described orthodynamic system to the ear. Diaphragm 31 comprises, for example, a polyester foil of about 3 microns in thickness provided with printed circuits 32 and 33 in accordance with FIG. 9. Here again, the magnetic system includes a plurality of magnetic rods 19 and 20 which are arranged at both sides of diaphragm 31 and are narrowly spaced therefrom. They are firmly anchored in a frame 21 by which diaphragm 31 is also supported. In view of the teaching of the invention that no sound-reflecting bodies are to be present within the boundaries of the coupling space, it is necessary to design the magnetic bodies as small as possible in order to obtain a hindrance-free passage of the sound waves. Therefore, advantageously, magnetic alloys of lanthanide series and cobalt will be used having a high energy density ((BH) max) of about 135 kJ/cm$^3$ and a coercive force of 15 kA/cm. This makes it possible to provide individual magnets of relatively small dimensions, so that large spaces can be obtained therebetween which barely hinder the passage of sound.

Frame 21 also supports the annular ear pad 22 whose wedge-like shape allows the oblique position of diaphragm 31 relative to the user's temple and which, in addition, seals coupling space 23 by which the ear is surrounded closely, but still without contact. The position of printed circuits 32 and 33 relative to each other on diaphragm 31 is such that with the headset on, the respective covered diaphragm areas come into different positions relative to the auditory canal 25, one ahead of the canal, and one behind the canal, so that the resonances of external ear 24 are excited by one transducer from the front side and by the other transducer from the rear side, which leads to different ear signals, in accordance with a wearer's natural hearing. Since the ear resonances only appear in the higher frequency range, at about 800 Hz, the sound transmission in the low frequency ranges depends only on the ratio of the volume displacement of the diaphragm to the coupling volume. In the low frequency range, substantially only delay times of the two ear signals of the right and left ears are determining for the directional and distance hearing.

Figure 11:
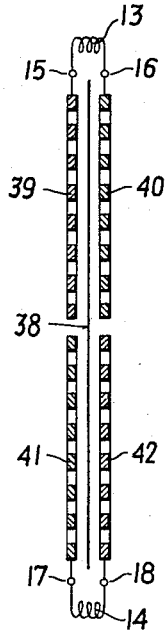
FIG. 11 is a diagrammatical sectional view of a transducer system with an electret diaphragm.

All of this also applies to the electrostatic transducer shown in FIG. 11, which is equipped with an electret diaphragm 38. It is advantageous to provide the diaphragm with a permanent charge, either only positive, or only negative. Such diaphragms, having a thickness of about 3 to 10 microns and made of a high-polymeric foil, for example, polyester or "Teflon", satisfy the requirements of the invention by their mechanical and acoustic properties. Diaphragm 38 is only slightly stretched, so as to prevent an undulation and to obtain a basic resonance which is as low as possible, for example, of about 150 Hz.

Diaphragm 38 may be designed in a manner known per se, with or without a conducting layer, and thus may also present a dielectric having a high electric resistance, and may be provided with an electric connection on its periphery. The arrangement of electrodes 39, 40, 41 and 42 is substantial for the invention and permits a partial drive of diaphragm 38 which is placed between two pairs of symmetrically opposed electrodes. The electrodes are supplied with power through terminals 15, 16, for one transducer, and through terminals 17 and 18 for the other transducer, and the terminals may be connected, for example, to transformers 13 and 14.

Figure 12:
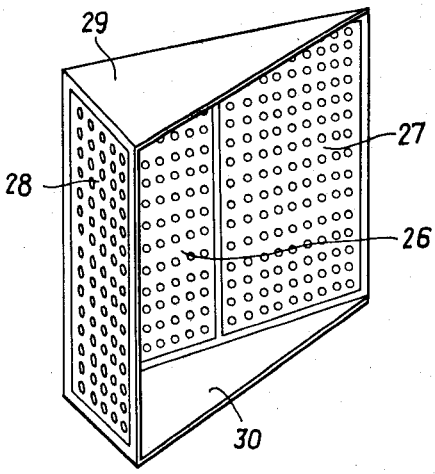
FIG. 12 is a basic illustration of an earpiece comprising an electrostatic arrangement in accordance with FIG. 11 and, in addition, a further transducer element.

In a development of the invention which is suitable to further contribute to a still better approach to natural hearing, a design may be provided, as shown in a simplified manner in FIG. 12, in which, in addition to a surface-driven diaphragm, such as shown in FIGS. 9 and 10 as a component part of an orthodynamic transducer, or in FIG. 11 as a component part of an electrostatic transducer, at least one further diaphragm is arranged at an angle to the first one. To simplify the drawings, only the electrostatic variant of the invention is shown in this connection in FIG. 12.

Diaphragm 38 of an electrostatic transducer, in accordance with FIG. 11, extends behind electrodes 26 and 27 and is therefore not visible. The additional diaphragm forming an angle with diaphragm 38 is also covered in the view by the visible, perforated electrode 28. Surfaces 29 and 30 form the remaining boundaries of the coupling space and they also might be replaced by transducers with surface-driven diaphragms. The diaphragms, which may be positioned at any angles relative to each other, may be electrically coupled to each other, at least partially, so that various surface combinations may be provided to obtain different acoustic effects, particularly with multi-channel transmissions.

It should be noted that in FIG. 12, the ear pad with a height of 3 to 5 cm at most, has been omitted in order not to affect the clarity of the showing. The inside dimensions of the pad correspond to the perimeter of the case formed by the transducers, so that, as already mentioned, with the exception of the low inside surface of the ear pad, no sound reflecting surfaces are present. The position of the individual diaphragms relative to each other and the partial drive of the diaphragm surfaces and the power supply to the surface combinations make it possible to excite the ear resonances in a manner corresponding to natural hearing.

It is important to the invention that, in practice, the diaphragms are permeable to sound waves of higher frequencies, while, at the same time, they are capable of radiating sound upon an electric excitation. The permeability is due to the fact that because of their small mass and minute rigidity, the diaphragms are pulled in step with the incident sound waves without losses and in accordance with the motion of the air molecules, but also transmit acoustic waves themselves, owing to their drive.

Figure 13:
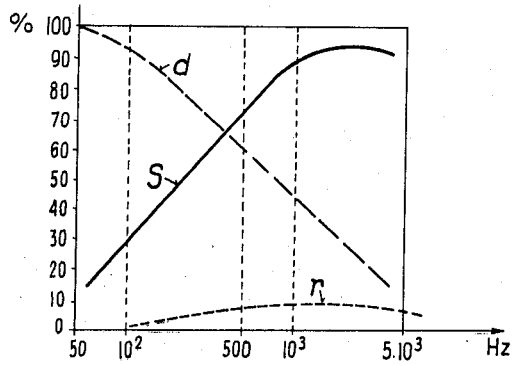
FIG. 13 is a graph showing the relationship between the coefficient of absorption, the transmittance and the reflection factor of a damping material.

As mentioned above, one of the objectives of the invention is to prevent a disturbance of the ambience by a sound passing out of the headset. To this end, the backside of the diaphragm is preferably sealed to the outside with a sound-absorbing material. The effect of such a provision is explained by FIG. 13 which shows that the coefficient of absorption S increases in substantially the same proportion in which the transmittance d decreases. At 1000 Hz, the acoustical absorptivity of the material has already risen to 90%, while the transmittance has dropped to about 40%. The reflection coefficient r, which only becomes measurable in the range above 100 Hz, does not reach more than 10%. Such curves are obtained, for example, with loose felt, aerated plastics, sintered materials, etc., with a prerequisite being a corresponding thickness of the material.

Figure 14:
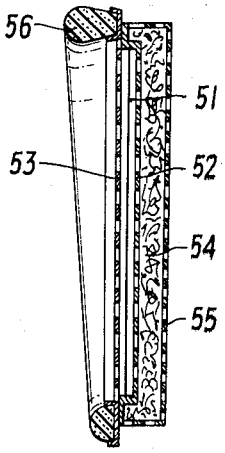
FIG. 14 is a diagrammatical sectional view of an embodiment with an orthodynamic drive of the diaphragm.

In the embodiment shown in FIG. 14, an orthodynamic transducer system is provided having a diaphragm 51 mounted for oscillation between magnetic poles 52 and 53. The element 54 which, in accordance with the invention, is made of a substantially non-reflecting material, is enclosed in, and retained by, a grid 55 which perfectly transmits sound. As usual, an ear pad 56 is provided to close the coupling space at the ear.

Figure 15:
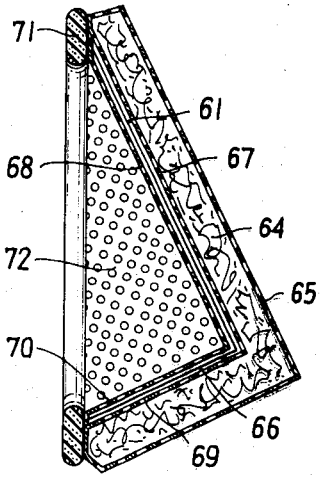
FIG. 15 is a similar view of an embodiment with electrostatically driven plane diaphragms.

Another embodiment with an electrostatic drive of the diaphragms is shown in FIG. 15 in a diagrammatical sectional view. The diaphragms 61 and 66, for example, unipolar electret diaphragms, are mounted for oscillation between electrodes 67, 68, 69 and 70. The porous material provided in accordance with the invention, which must not cause any reflection in the coupling space, is shown at 64. It is held in place and covered by a protective grid 65. Here again, a flat ear pad 71 seals the coupling space. In this embodiment, a triangular transducer system with an electrode 72 is further provided, and an identical system on the underside of the earphone. Thus, the earphone shown in FIG. 15 comprises four transducer systems bounding the coupling space, so that there are no acoustically stiff surfaces in this space which could cause reflections. The extremely flat ear pad 71 also contributes to the elimination of reflections.

Figure 16:
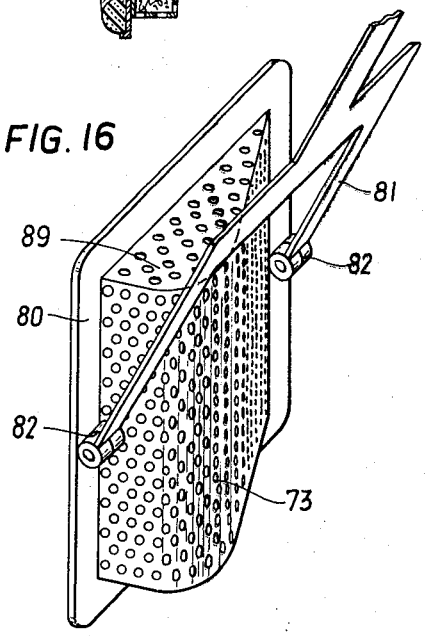
FIGS. 16 and 17 show electrostatic systems with a curved diaphragm.
Figure 17:
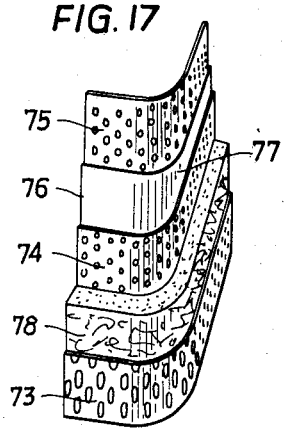

FIGS. 16 and 17 also show an embodiment with an electrostatic drive of the diaphragms, in which at least one of the plane transducer systems is replaced by a system comprising a curved electrode arrangement. FIG. 16 is an axonometric view of the whole arrangement. FIG. 17 shows the internal structure of such an earphone. Behind the case 73, which is substantially perfectly sound-transmitting and must not comprise any reflecting surfaces, electrodes 74 and 75 are provided, and therebetween, a diaphragm 77 is stretched in a frame. The element 78 absorbing frequencies above 1 kHz comprises a layer of loose felt.

As shown in FIG. 16, a plane transducer 89 is provided on the top and the underside of the earphone (the underside is not visible in the figure), to complete the coupling space. The earphone of FIG. 16 further comprises the usual ear pad 80, which is very flat to avoid reflecting surfaces, and a harness yoke 81 which is hinged at 82 and provides a connection to the headband.

The headset design in accordance with the invention may also serve audiometric purposes, as a basis ear, the sound perception corresponding to natural hearing.

While specific embodiments of the invention have been shown and described in detail to illustrate the application of the principles of the invention, it will be understood that the invention may be embodied otherwise without departing from such principles.

What is claimed is:

1. An earphone for a person's ear, comprising, an ear pad adapted to surround the ear, at least one electroacoustic transducer having a housing supported on said ear pad, and a surface-driven diaphragm with a periphery directly supported on said housing and having a surface area larger than that of the ear, said at least one diaphragm comprising two surface-driven diaphragm parts disposed at substantially right angles to each other, said electroacoustic transducer including a housing portion of wedge-shaped configuration joined directly to said ear pad having walls at right angles to each other, said ear pad being of a similar configuration with said diaphragm parts extending across substantially said entire walls.

2. An earphone construction for being worn over an auricle of a person's ear comprising, an ear pad adapted to be surround the auricle of a person's ear and be free from contact therewith, at least one electroacoustic transducer supported on said ear pad at a location adapted to be free from contact with the auricle and defining therewith a coupling space, the electroacoustic transducer having a minimum of sound reflecting surfaces, and including a surface-driven diaphragm of low mass so that the mechanical impedance thereof, in the audible frequency range, is small with respect to the acoustic radiation resistance thereof, the diaphragm having a periphery supported on said ear pad adapted to be in contact-free and close proximity to the auricle and defining a boundary of the coupling space whereby said diaphragm reflects substantially no sound in the coupling space, a surface of said diaphragm facing away from the coupling space being in direct contact with air outside the coupling space and the surface area of said diaphragm exceeding that of the auricle and adapted to extend beyond the auricle on all sides thereof, said at least one diaphragm comprising two surface-driven diaphragm parts disposed at substantially right angles to each other, said electroacoustic transducer including a housing portion of wedge-shape configuration joined directly to said ear pad and said ear pad being of a similar configuration.

3. An earphone construction for being worn over an auricle of a person's ear comprising, an ear pad adapted to surround the auricle of the person's ear and be free from contact therewith, at least one electroacoustic transducer supported on said ear pad at a location adapted to be free from contact with the auricle and defining therewith a coupling space, the electroacoustic transducer having a minimum of second reflecting surfaces, and including a surface-driven diaphragm of low mass so that the mechanical impedance thereof, in the audible frequency range, is small with respect to the acoustic radiation resistance thereof, the diaphragm having a periphery supported on said ear pad adapted to be in contact-free and close proximity to the auricle and defining a boundary of the coupling space whereby said diaphragm reflects substantially no sound in the coupling space, a surface of said diaphragm facing away from the coupling space being in direct contact with air outside the coupling space and the surface area of said disphragm exceeding that of the auricle and adapted to extend beyond the auricle on all sizes thereof, said electroacoustic transducer comprising a substantially wedge-shaped housing, said ear pad being substantially flat, said wedge-shaped housing holding said diaphragm so that it has a part which extends substantially parallel to the surface of the ear and wherein said at least one diaphragm comprises a lower diaphragm part extending outwardly from the ear.

4. An earphone, as claimed in claim 3, wherein said electroacoustic transducer includes a separately operated power connection to each of said diaphragm parts.

5. An earphone construction for being worn over an auricle of a person's ear comprising, an ear pad adapted to surround the auricle of the person's ear and be free from contact therewith, at least one electroacaustic transducer supported on said ear pad at a location adapted to be free from contact with the auricle and defining therewith a coupling space, the electroacoustic transducer having a minimum of sound reflecting surfaces, and including a surface-driven diaphragm of low mass so that the mechanical impedance thereof, in the audible frequency range, is small with respect to the acoustic radiation resistance thereof, the diaphragm having a periphery supported on said ear pad adapted to be in contact-free and close proximity to the auricle and defining a boundary of the coupling space whereby said diaphragm reflects substantially no sound in the coupling space, a surface of said diaphragm facing away from the coupling space being in direct contact with air outside the coupling space and the surface area of said diaphragm exceeding that of the auricle and adapted to extend beyond the auricle on all sides thereof, said electroacoustic transducer comprising at least two mutually independent drive systems for driving said diaphragm.

6. An earphone, as claimed in claim 5, wherein said electroacoustic transducer is an orthodynamic transducer, said surface-driven diaphragm including at least two conductor tracks thereon and said transducer including magnetic means spaced from said diaphragm.

7. An earphone, according to claim 6, wherein said diaphragm is of a thickness of 10 microns of less and said conductor tracks are made of aluminum.

8. An earphone construction for being worn over an auricle of a person's ear comprising, an ear pad adapted to surround the auricle of the person's ear and be free from contact therewith, at least one electroacoustic transducer supported on said ear pad at a location adapted to be free from contact with the auricle and defining therewith a coupling space, the electroacoustic transducer having a minimum of sound reflecting surfaces, and including a surface-driven diaphragm of low mass so that the mechanical impedance thereof, in the audible frequency range, is small with respect to the acoustic radiation resistance thereof, the diaphragm having a periphery supported on said ear pad adapted to be in contact-free and close proximity to the auricle and defining a boundary of the coupling space whereby said diaphragm reflects substantially no sound in the coupling space, a surface of said diaphragm facing away from the coupling space being in direct contact with air outside the coupling space and the surface area of said diaphragm exceeding that of the auricle and adapted to extend beyond the auricle on all sides thereof, said at least on diaphragm comprising a first diaphragm part extending obliquely away from said ear pad and at least one independent drive connected to said first diaphragm part for operating said first diaphragm part, at least one further surface-driven diaphragm part connected to the first diaphragm part and forming a boundary of a coupling space, and a further independent drive connected to said further diaphragm part having its own separate power source.

9. An earphone construction for being worn over an auricle of a person's ear comprising, an ear pad adapted to surround the auricle of the person's ear and be free from contact therewith, at least one electroacoustic transducer supported on said ear pad at a location adapted to be free from contact with the auricle and defining therewith a coupling space, the electroacoustic transducer being substantially acoustically transparent, and including a surface-driven diaphragm having mass of about 0.04 grams, with the mechanical impedance thereof, in the audible frequency range, being low with respect to the acoustic radiaton resistance thereof, the diaphragm having a periphery supported on said ear pad so as to be in contact-free and close proximity to the auricle and defining a boundry of the coupling space whereby said diaphragm reflects substantially no sound in the coupling space, a surface of said diaphragm facing away from the coupling space being in direct contact with air outside the coupling space and the surface area of said diaphragm exceeding that of the auricle and extending beyond the auricle on all sides thereof.

10. An earphone as claimed in claim 9, including a porus, sound-deadening non-reflecting material extending over and spaced from the entire outer surface area of the diaphragm, absorbing particularly acoustic oscillations in the medium and higher auditory ranges, so that the sound energy of the medium and higher frequency ranges, upon entering the porous material, and due to the internal friction thereof, is converted into heat and dissipated while the sound energy of the lower frequencies is dampened less than the higher frequencies and passes through the porous material.

11. An earphone construction according to claim 9, wherein said diaphragm is chosen to have a thickness of 10 microns or less.

* * * * *

UNITED STATES PATENT AND TRADEMARK OFFICE

CERTIFICATE OF CORRECTION

PATENT NO. : 4,278,852

DATED : July 14, 1981

INVENTOR(S) : Rudolf Gorike

It is certified that error appears in the above—identified patent and that said Letters Patent is hereby corrected as shown below:

On The Title Page, the Assignee should read

-- AKG Akustische u. Kino-Geräte Gesellschaft m.b.H. --.

Signed and Sealed this

*Second* Day of *February 1982*

[SEAL]

*Attest:*

GERALD J. MOSSINGHOFF

*Attesting Officer*

*Commissioner of Patents and Trademarks*